US007030562B2

(12) United States Patent
Tachibana et al.

(10) Patent No.: US 7,030,562 B2
(45) Date of Patent: Apr. 18, 2006

(54) PLASMA DISPLAY PANEL HAVING CAPABILITY OF PROVIDING PRIMING DISCHARGE BETWEEN OPPOSING ELECTRODES

(75) Inventors: Hiroyuki Tachibana, Osaka (JP); Naoki Kosugi, Kyoto (JP); Tomohiro Murakoso, Hyogo (JP); Nobuaki Nagao, Osaka (JP); Ryuichi Murai, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/494,279

(22) PCT Filed: Oct. 24, 2003

(86) PCT No.: PCT/JP03/13634

§ 371 (c)(1),
(2), (4) Date: Apr. 30, 2004

(87) PCT Pub. No.: WO2004/042766

PCT Pub. Date: May 21, 2004

(65) Prior Publication Data

US 2005/0040766 A1 Feb. 24, 2005

(30) Foreign Application Priority Data

Nov. 5, 2002 (JP) ..... 2002-320898
Feb. 20, 2003 (JP) ..... 2003-042862

(51) Int. Cl.
*H01J 17/49* (2006.01)

(52) U.S. Cl. ..... 313/583; 313/582

(58) Field of Classification Search ..... 313/582–589
See application file for complete search history.

(56) References Cited

U.S. PATENT DOCUMENTS

| | | | | |
|---|---|---|---|---|
| 6,313,580 | B1 * | 11/2001 | Makino | 313/582 |
| 6,400,081 | B1 * | 6/2002 | Matsumoto et al. | 313/582 |
| 6,496,167 | B1 * | 12/2002 | Makino | 313/582 |
| 2001/0020924 | A1 | 9/2001 | Makino | |
| 2005/0099125 | A1 * | 5/2005 | Tachibana et al. | 313/585 |
| 2005/0104807 | A1 * | 5/2005 | Tachibana et al. | 345/60 |
| 2005/0146274 | A1 * | 7/2005 | Tachibana et al. | 313/585 |
| 2005/0156524 | A1 * | 7/2005 | Tachibana et al. | 313/586 |
| 2005/0242726 | A1 * | 11/2005 | Mizuta | 313/582 |

FOREIGN PATENT DOCUMENTS

| | | |
|---|---|---|
| JP | 08-96714 | 4/1996 |
| JP | 08-328506 | 12/1996 |
| JP | 09-245627 | 9/1997 |
| JP | P2000-200553 | 7/2000 |
| JP | P2001-195990 | 7/2001 |
| JP | P2002-150949 | 5/2002 |
| JP | P2002-297091 | 10/2002 |

* cited by examiner

*Primary Examiner*—Joseph Williams
*Assistant Examiner*—Peter Macchiarolo
(74) *Attorney, Agent, or Firm*—McDermott Will & Emery LLP

(57) ABSTRACT

The invention is a plasma display panel capable of stabilizing the addressing characteristics. A barrier rib is formed by longitudinal barrier ribs portion orthogonal to the scan electrodes and sustain electrodes on the front substrate, and side barrier rib portions crossing with these longitudinal barrier rib portions, to form cell spaces and form interstice portions between the cell spaces, and priming electrodes for producing a discharge between the front substrate and the rear substrate within the interstice portions are formed. Stable priming discharge is produced with certainty by the scan electrode and the priming electrode, hence decreasing the discharge time lag at the time of addressing and stabilizing the addressing characteristics.

15 Claims, 17 Drawing Sheets

PLASMA DISPLAY PANEL HAVING CAPABILITY OF PROVIDING PRIMING DISCHARGE BETWEEN OPPOSING ELECTRODES

TECHNICAL FIELD

The present invention relates to a plasma display panel for use in a wall-hung TV or a large-screen monitor.

BACKGROUND ART

In a typical AC-type surface-discharge alternating-current plasma display panel, a front substrate made of glass where scan electrodes and sustain electrodes for performing a surface discharge are arranged and a rear substrate made of glass where data electrodes are arranged are disposed so that the former and latter electrodes are arranged opposite each other in parallel to form a matrix with a discharge space between, and the outer periphery is sealed by sealing material such as glass frit. Discharge cells sectioned by barrier ribs are provided between the substrates and a phosphor layer is formed on the discharge cells between these barrier ribs. In the thus-constituted plasma display panel, gas discharges an ultraviolet light and this ultraviolet light excites Red, Green, and Blue phosphors, hence carrying out color display (refer to Japanese Patent Laid-Open No. 2001-195990).

In this plasma display panel, one field is divided into a plurality of sub-fields and gradation is displayed by driving a combination of the light emitting sub-fields. Each sub-field comprises a reset period, an address period, and a sustain period. In order to display image data, the signal waveforms respectively different in the reset period, the address period, and the sustain period are applied to the respective electrodes.

In the reset period, for example, a positive pulse voltage is applied to all the scan electrodes, and a necessary wall charge is accumulated on the protective film and the phosphor layer on a dielectric layer covering the scan electrode and the sustain electrode.

In the address period, all the scan electrodes are scanned by sequentially applying a negative scan pulse there, and in the case where there is display data, when a positive data pulse is applied to the data electrode during the scan of the scan electrodes, a discharge occurs between the scan electrode and the data electrode and a wall charge is formed on the surface of the protective film on the scan electrode.

In the next sustain period, a voltage enough to support a discharge between the scan electrode and the sustain electrode is applied for a predetermined period. Through this measure, a plasma discharge is generated between the scan electrode and the sustain electrode, and the phosphor layer is excited to emit light for the predetermined period. In the discharge space where the data pulses were not applied during the address period, no discharge occurs, and excitation and light-emission of the phosphor layer does not occur.

In the thus configured plasma display panel, there has been a problem that writing operation is made unstable because of a large discharge time lag in the discharge during the address period or else too much time is taken for the address period because the writing time is set longer in order to completely perform the writing operation. In order to solve the above problem, there has been proposed a panel in which an auxiliary discharge electrode is provided on the front substrate, and the auxiliary discharge within the surface of the front substrate generates a priming discharge which decreases the discharge time lag, and a driving method for this panel (refer to Japanese Patent Laid-Open No. 2002-297091).

In this plasma display panel, however, there arises the problem that when the number of lines is increased as screen resolution becomes finer, the address time must be made longer, and accordingly it is necessary to decrease the time for the sustain period, and it is difficult to obtain brightness. Further, also in the case of increasing the partial pressure of xenon in order to increase the brightness and efficiency, there is the problem that the discharge starting voltage increases and discharge time lag is increased, hence to deteriorate the address characteristic. Since the address characteristics are much affected by the manufacturing process, it is necessary to decrease the discharge time lag during addressing to shorten the address time and lessen the effects of random production disuniformities.

With respect to this request, the conventional plasma display panel performing the priming discharge within the front substrate has a problem of failing to shorten the discharge time lag fully during writing, there is the problem that there is a tendency for wrong discharge in some panels because the margin of error for the auxiliary discharge is small, and further the problem that crosstalk is generated as the result of supplying more priming particles than is necessary for priming to adjacent discharge cells. A certain distance between the electrodes is necessary in order to realize the stable auxiliary discharge for supplying the priming particles. Therefore, the auxiliary discharge cell becomes larger to accommodate the auxiliary discharge within the front substrate, and a finer resolution panel cannot be achieved.

DISCLOSURE OF THE INVENTION

Taking the above problems into consideration, an object of the present invention is to provide a plasma display panel capable of stabilizing the address characteristics even in the case of a finer-pitch panel.

In order to achieve the above object, a plasma display panel of the invention comprises first electrodes and second electrodes arranged on a first substrate in parallel and alternating with each other and covered with a dielectric layer, third electrodes arranged on a second substrate disposed facing the first substrate with a discharge space therebetween and intersecting the axes of the first electrodes and the second electrodes, and fourth electrodes arranged on the second substrate for producing a discharge between fourth electrodes and the first electrodes or between fourth electrodes and the second electrodes.

According to this structure, since a priming discharge is vertically performed on the first substrate and the second substrate, it is possible to realize a plasma display panel superior in address characteristic by downsizing an auxiliary discharge cell, thus enabling a finer-pitch panel and making priming discharge stable.

Further, barrier ribs for sectioning a plurality of discharge cells formed by the first electrodes, the second electrodes, and the third electrodes may be provided on the second substrate and a phosphor layer may be provided on the discharge cells. Further, it is preferable that the barrier rib consists of longitudinal barrier rib portions extending orthogonal to the first electrodes and the second electrodes and side barrier rib portions crossing these longitudinal barrier rib portions so as to form interstice portions, and that the fourth electrode is formed on the second substrate of the interstice portion.

With the above structure, a stable priming discharge can be assuredly generated between the first substrate and the second substrate in the interstice portion, the priming particles can be supplied to the adjacent discharge cell in the same row, and the discharge time lag at a time of addressing can be decreased irrespective of the material characteristics of the phosphor layer, thereby stabilizing the address characteristic.

Further, the interstice portion may be continuously formed by the adjacent side barrier rib portions in parallel with the first electrode and the second electrode. Therefore, the priming discharge can be diffused in the interstice portion, thereby stabilizing the priming to the respective discharge cells.

Further, a light absorption layer may be formed on the first substrate at a position corresponding to the discharge space formed by the fourth electrode. Therefore, the light absorption layer can absorb the light emission in the interstice portion and prevent deterioration of contrast by the priming discharge produced within the interstice portion.

Further, it is preferable that the light absorption layer is formed on a surface of the first substrate facing the discharge space. Therefore, the light emission by the priming discharge is confined to the interstice portion, thereby further improving the contrast.

The fourth electrode may be formed at a position nearer to the discharge space than the third electrode, the discharge voltage of the priming discharge within the interstice portion can be made less than the discharge voltage of the discharge cell using the third electrode, and prior to the address discharge of the discharge cell, it is possible to produce a stable priming discharge.

The third electrode may be formed at a position nearer to the discharge space than the fourth electrode. Accordingly, the address discharge voltage generated by the third electrode can be decreased.

Further, when a scan pulse is applied, a priming discharge is produced between the first electrode where the scan pulse is applied and the fourth electrode. Therefore, it is possible to produce, when most necessary for the discharge cell, an optimum priming discharge for the purpose of decreasing the discharge time lag at a time of addressing, and obtain more stable address characteristics.

Further, it is preferable that the first electrodes and the second electrodes are arranged in alternating lines. Therefore, since the electrodes of the adjacent portions of the discharge cells in the column direction become the same potential, the charge and discharge electricity consumed between the adjacent cells is decreased and the electricity is reduced.

Further, the fourth electrode is formed on the second substrate corresponding to the portion where the first electrodes applied the scan pulse are adjacent to each other. Therefore, a wrong discharge occurring between the second electrode and the fourth electrode can be prevented and stable operation can be performed.

Further, it is preferable that a discharge area for inducing a discharge between the first electrode on the first substrate and the fourth electrode on the second substrate is formed in a portion outside the display area. According to this structure, it is possible to decrease the time lag of the priming discharge itself which is produced within the interstice portion by discharging in a peripheral discharge area, realize higher-speed addressing, and shorten the address time.

Further, it is preferable that the fourth electrode for producing a discharge between the first substrate and the second substrate produces a discharge by applying a positive voltage pulse during the address period and further that the positive voltage value to be applied to the fourth electrode during the address period is set larger than the voltage value to be applied to the third electrode during the address period. Therefore, it is possible to produce a priming discharge more assuredly within the interstice portion.

DETAILED DESCRIPTION OF PREFERRED EMBODIMENTS

Hereinafter, the plasma display panel according to the embodiments of the invention will be described by using the drawings.

[Embodiment 1]

Figure 1:
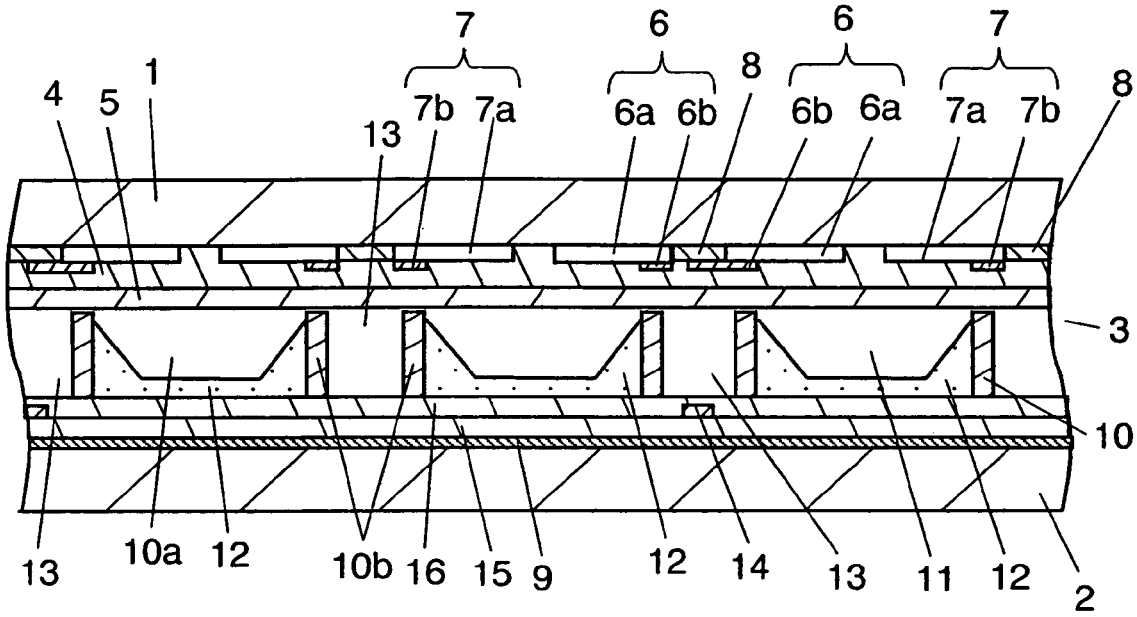
FIG. 1 is a cross sectional view showing a plasma display panel according to the embodiment 1 of the invention.
Figure 2:
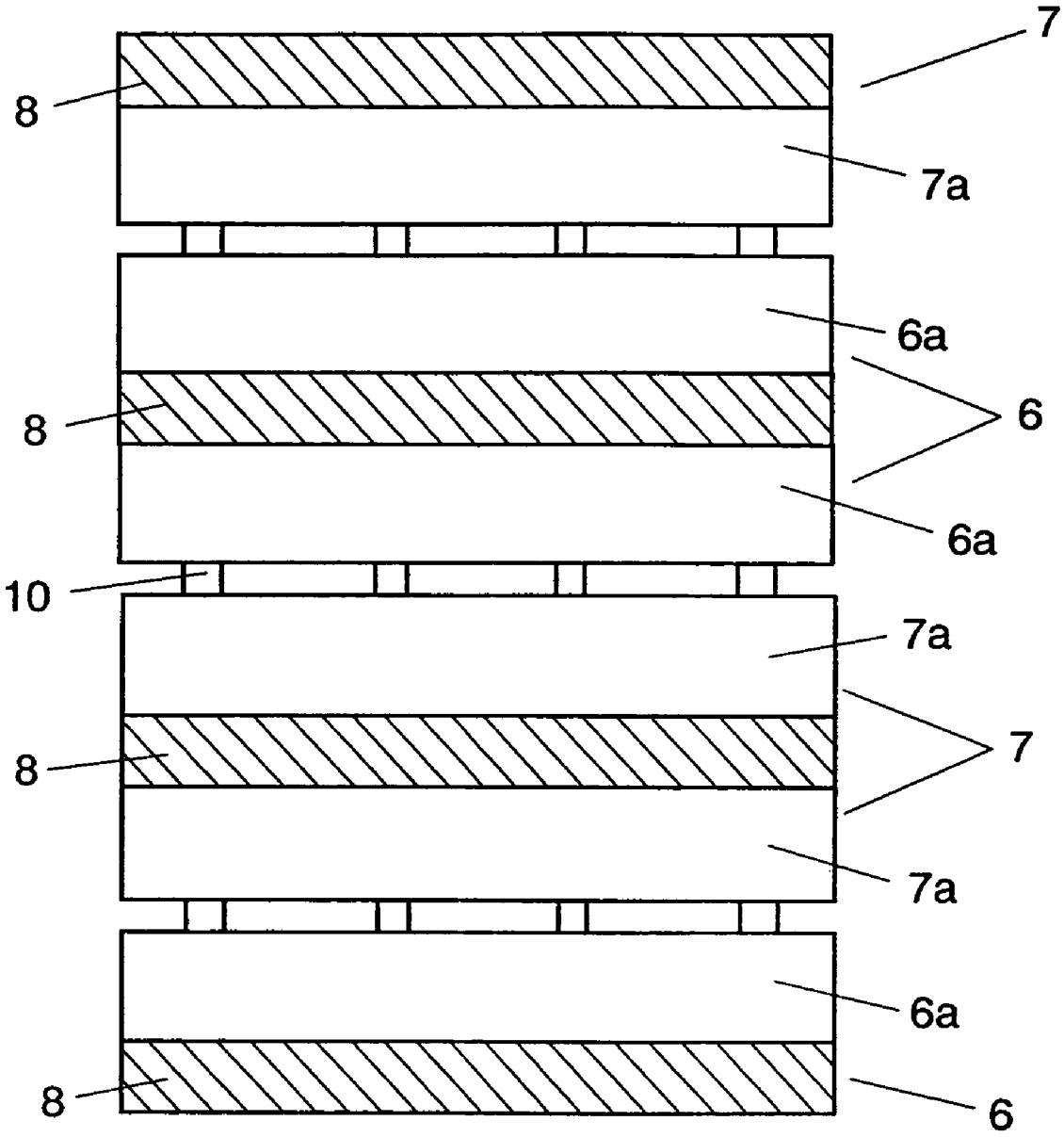
FIG. 2 is a plan view schematically showing the array of electrodes on the front substrate of the same plasma display panel.
Figure 3:
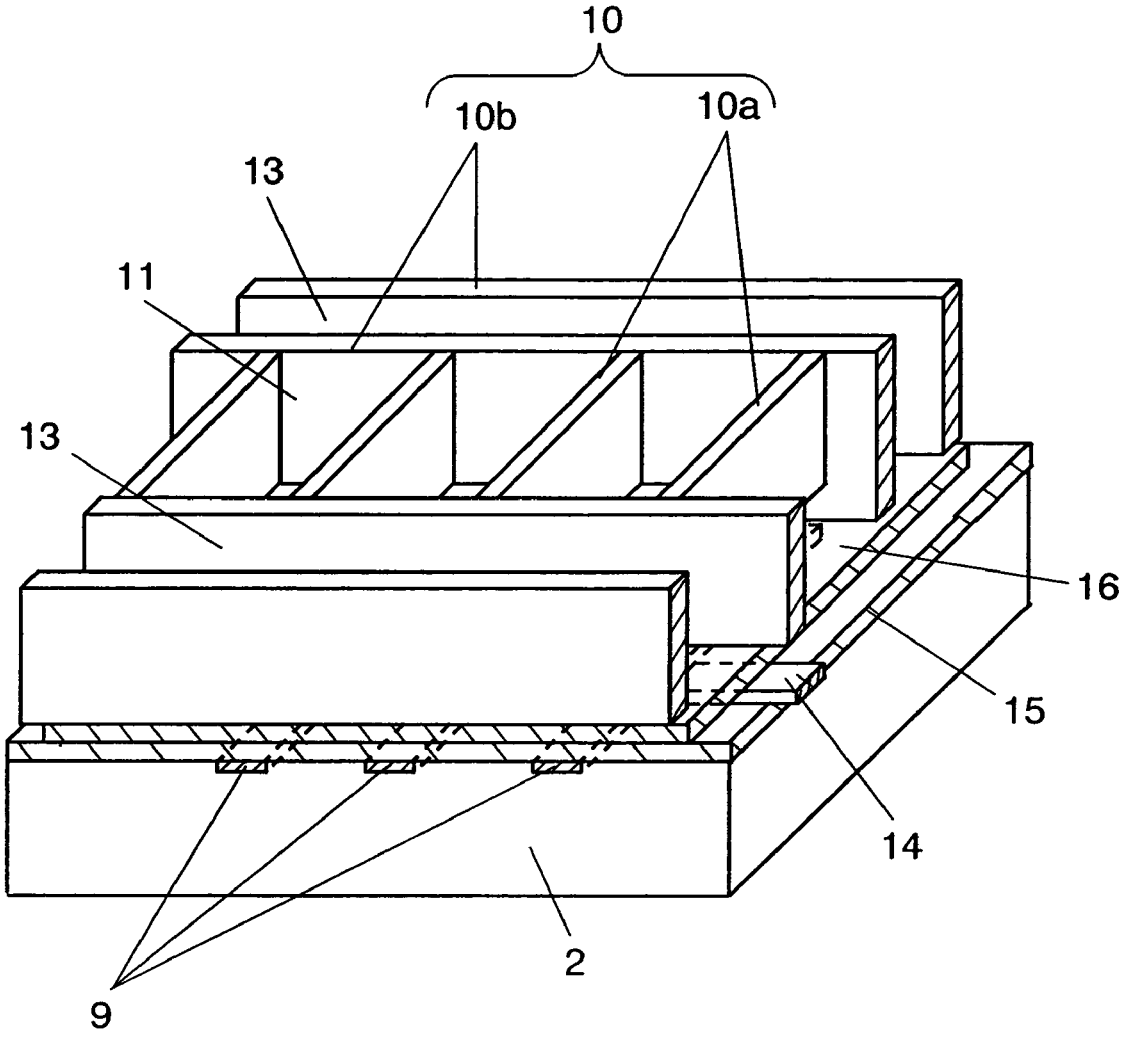
FIG. 3 is a perspective view schematically showing the rear substrate of the same plasma display panel.
Figure 4:
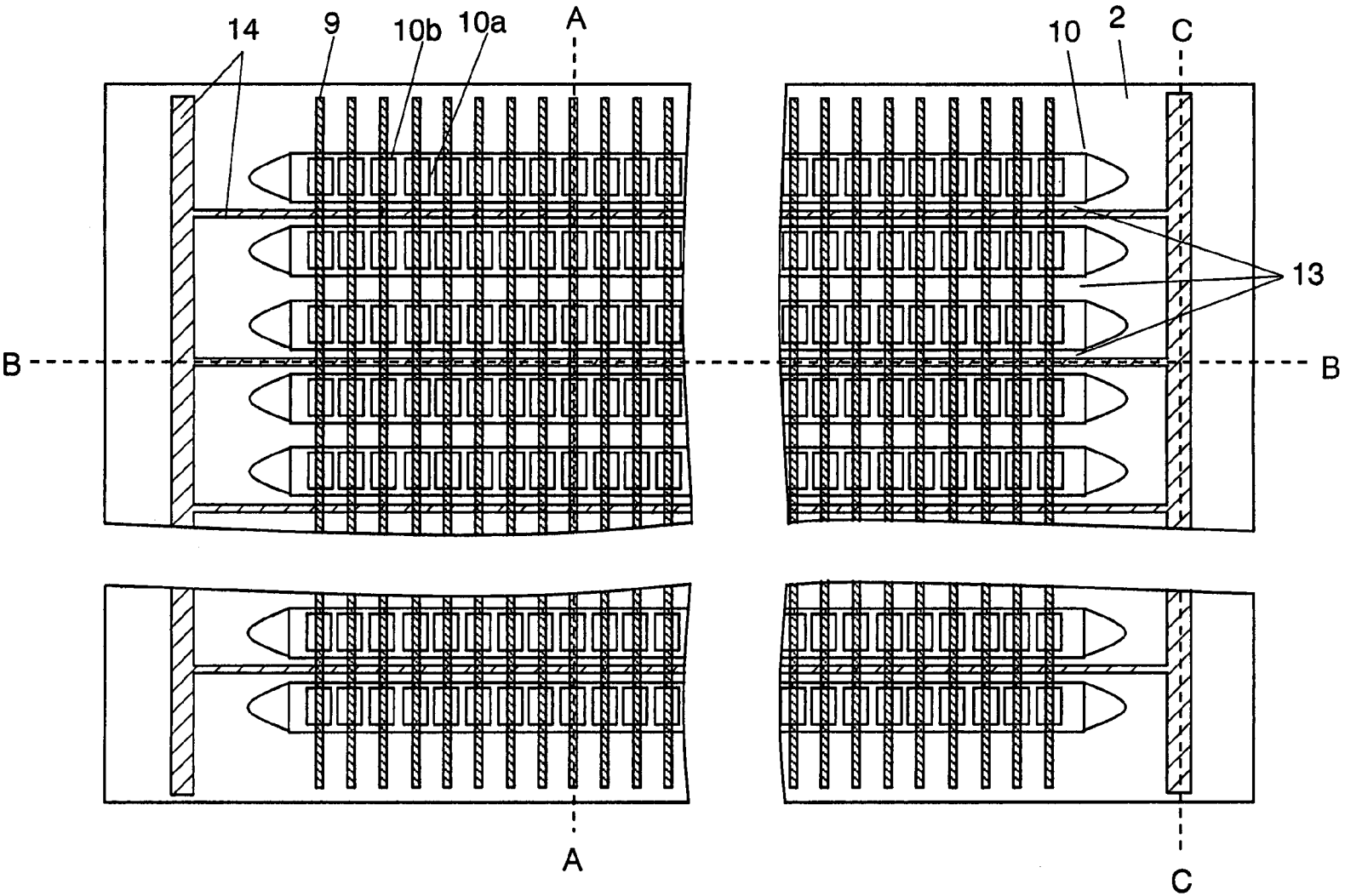
FIG. 4 is a plan view schematically showing the rear substrate of the same plasma display panel.
Figure 5:
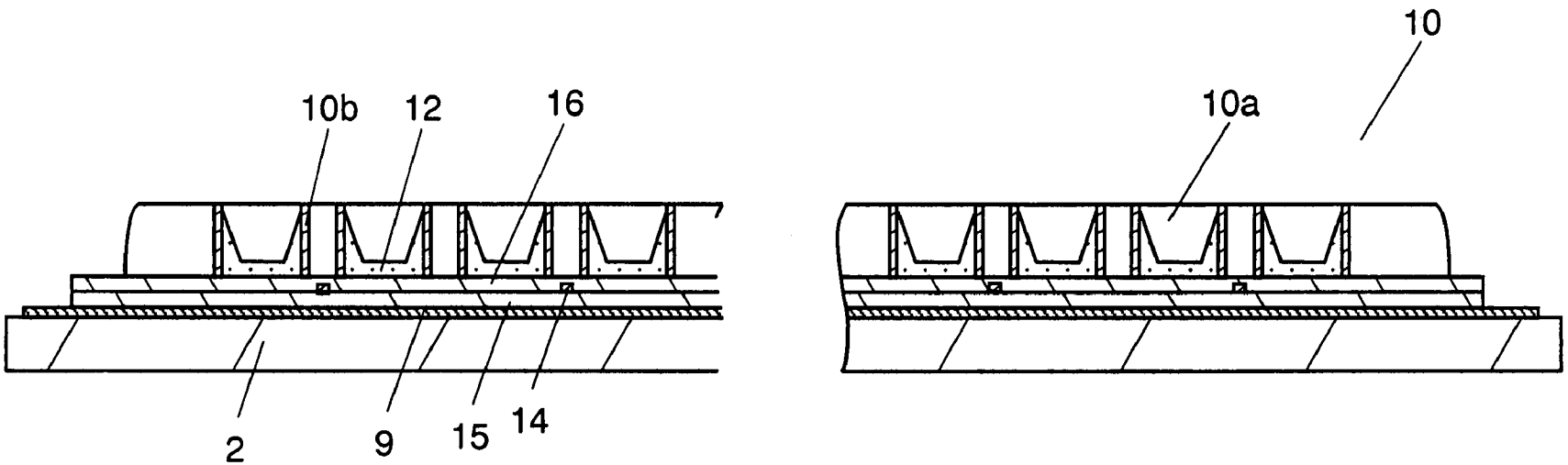
FIG. 5 is a cross sectional view cut off along the line A—A of FIG. 4.
Figure 6:
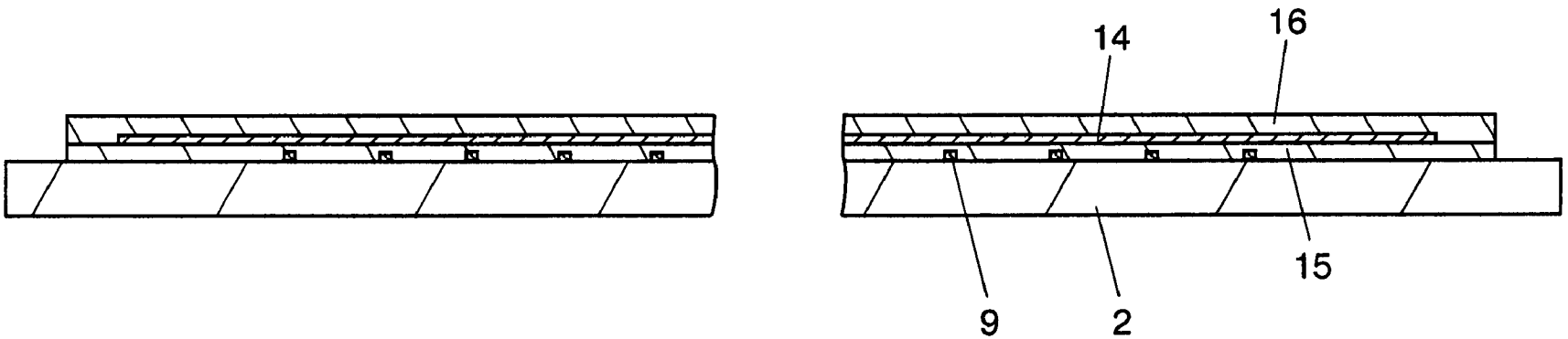
FIG. 6 is a cross sectional view cut off along the line B—B of FIG. 4.
Figure 7:
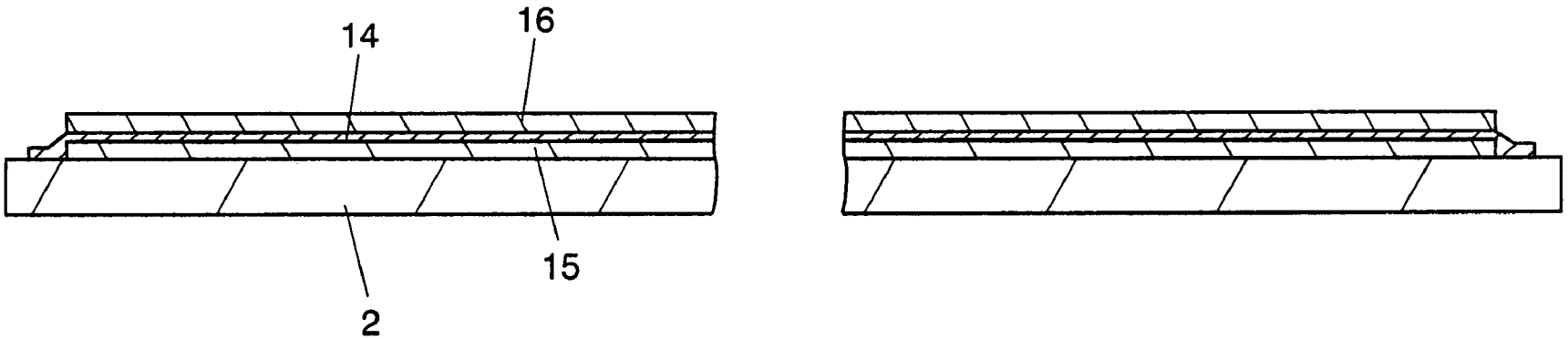
FIG. 7 is a cross sectional view cut off along the line C—C of FIG. 4.

FIG. 1 is a cross sectional view showing the plasma display panel according to the embodiment 1 of the invention, FIG. 2 is a plan view schematically showing the array of electrodes on the front substrate that is the first substrate, FIG. 3 is a perspective view schematically showing the rear substrate that is the second substrate, and FIG. 4 is a plan view of the rear substrate that is the second substrate. Further, FIG. 5, FIG. 6, and FIG. 7 are cross sectional views respectively cut off along the A—A line, the B—B line, and the C—C line of FIG. 4.

As shown in FIG. 1, a front substrate 1 made of glass that is the first substrate and a rear substrate 2 made of glass that is the second substrate are arranged facing each other with a discharge space 3 between them, and as a gas which radiates ultraviolet light when a discharge is applied, neon, xenon, or a mixture of them is charged in the discharge space 3. On the front substrate 1, an electrode group including pairs of scan electrodes 6 that are the strip-shaped first electrodes and pairs of sustain electrodes 7 that are the strip-shaped second electrodes, covered with a dielectric layer 4 and a protective film 5, are arranged in parallel with each other. The scan electrode 6 and the sustain electrode 7 respectively comprise transparent electrodes 6*a* and 7*a* and metal buses 6*b* and 7*b* made of silver or the like for increasing the conductivity, overlapping the transparent electrodes 6*a* and 7*a*.

Further, as illustrated in FIG. 2, the two scan electrodes 6 and the two sustain electrodes 7 are alternatively arranged in a sequence of scan electrode 6-scan electrode 6-sustain electrode 7-sustain electrode 7 . . . , and a light absorption layer 8 made of black material is respectively provided between the scan electrodes and between the sustain electrodes 7.

On the other hand, the structure of the rear substrate 2 will be described by using FIG. 1, FIGS. 3 to 7. On the rear substrate 2, a plurality of strip-shaped data electrodes 9 that are the third electrodes are arranged in parallel with one another but crossing the scan electrodes 6 and the sustain electrodes 7 at right angles. Further, barrier ribs 10 for dividing several discharge cells 11 each formed by a scan electrode 6, a sustain electrode 7, and a data electrode 9 are formed on the rear substrate 2, and phosphor layers 12 formed for each of the discharge cells 11 divided by these barrier ribs 10 are provided. The barrier rib 10 is formed by longitudinal barrier rib portions 10*a* extending orthogonal to the scan electrodes 6 and the sustain electrodes 7 provided on the front substrate 1, namely, parallel to the data electrodes 9, and side barrier rib portions 10*b* crossing with the longitudinal barrier ribs 10*a* so to form the discharge cells 11 as well as to form an interstice portion 13 between the discharge cells 11. The light absorption layer 8 formed on the front substrate 1 is formed at a position corresponding to the space of the interstice portion 13 formed between the side barrier ribs 10*b* of the barrier ribs 10.

In the interstice portion 13 of the rear substrate 2, a priming electrode 14 that is the fourth electrode for generating a discharge between the front substrate 1 and the rear substrate 2 within the space of the interstice portion 13 is formed orthogonal to the data electrode 9, and a priming discharge cell comprises the interstice portion 13. The interstice portions 13 are formed continuously in a direction orthogonal to the data electrodes. The priming electrode 14 is formed on the dielectric layer 15 which covers the data electrodes 9, another dielectric layer 16 is formed so as to cover the priming electrode 14, and the priming electrode 14 is formed at a position nearer to the space within the interstice portion 13 than the data electrode 9. Further, the priming electrode 14 is formed only in the portions of the interstice portion 13 facing the scan electrodes 6 to which a scan pulse is applied, and one portion of the metal buses 6*b* of the scan electrode 6 extends to a position facing the interstice portion 13 and is formed on the light absorption layer 8. Namely, a priming discharge is generated between the metal bus 6*b* of adjacent scan electrodes 6 and protruding toward the interstice portion 13, and the priming electrode 14 formed on the rear substrate 2.

Next, a method of displaying image data on the plasma display panel will be described by using FIG. 8. In a method of driving the plasma display panel, one field period is divided into a plurality of sub-fields each having the weight of the luminescent period, and gradation display is produced by combination of the sub-fields caused to emit light. Each sub-field is formed by a reset period, an address period, and a sustain period.

Figure 8:
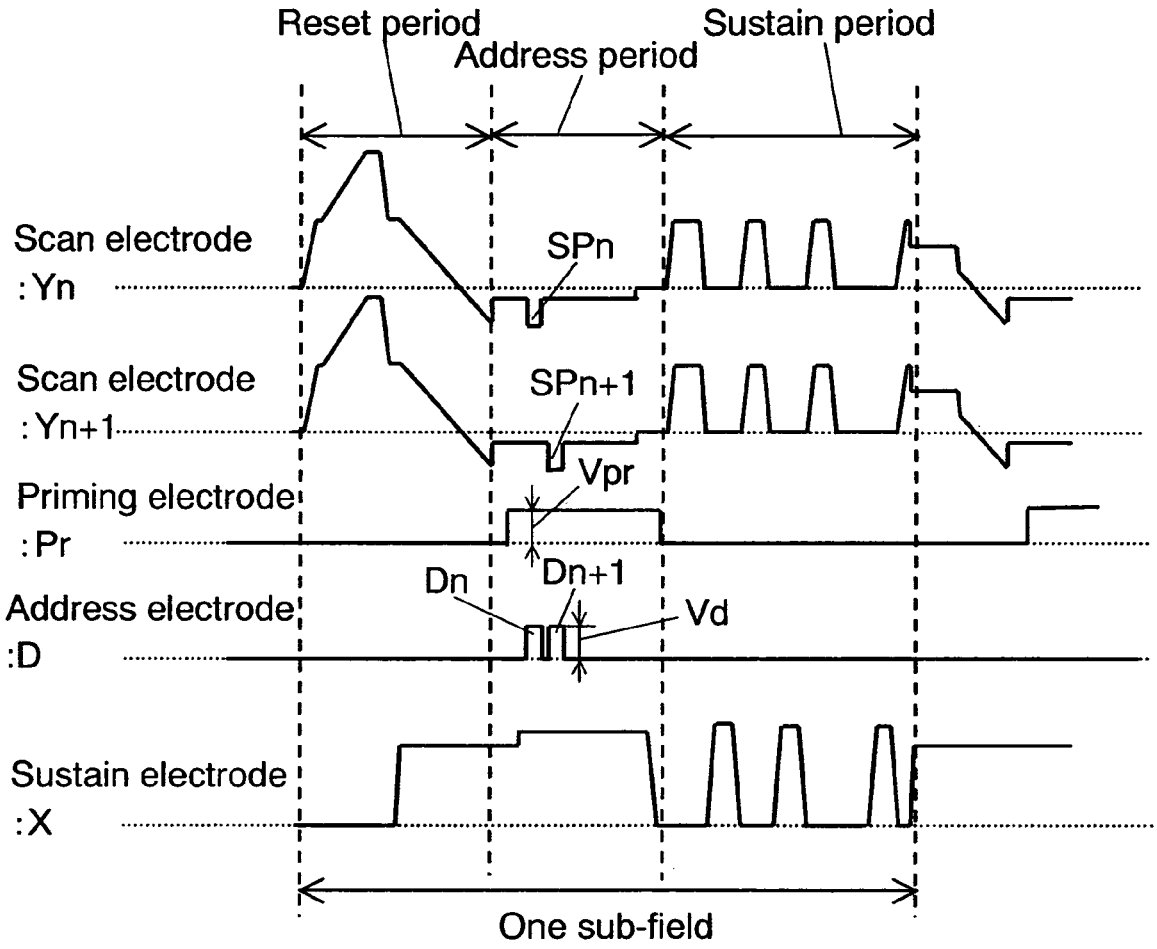
FIG. 8 is a waveform view showing one example of a driving waveform for operating the same plasma display panel.

FIG. 8 shows one example of the driving waveform for driving the above plasma display panel. In the reset period shown in FIG. 8, in the priming discharge cell where a priming electrode Pr (the priming electrode 14 in FIG. 1) has been formed, resetting is performed between the scan electrode Yn, one portion of which protrudes into the interstice portion (the interstice portion 13 in FIG. 1), and the priming electrode Pr. In the following address period, as illustrated in FIG. 8, a positive potential is always applied to the priming electrode Pr. Therefore, in the priming discharge cell, when a scan pulse SPn is applied to the scan electrode Yn, a priming discharge occurs between the priming electrode Pr and the scan electrode Yn. Accordingly, the discharge time lag at a time of addressing in the $n^{th}$ discharge cell is decreased according to this priming discharge, hence to stabilize the address characteristic.

Next, though the scan pulse SPn+1 is applied to the scan electrode Yn+1 of the $(n+1)^{th}$ discharge cell, since the priming discharge has occurred just before at this time, the discharge time lag at a time of addressing also becomes smaller in the $(n+1)^{th}$ discharge cell. Although only the description of the driving sequence of certain one field has been made here, the operation principle in the other sub-fields is the same.

Here, in the driving waveform shown in FIG. 8, a priming discharge can be produced steadily by applying a positive voltage to the priming electrode Pr during the address period. It is preferable that the voltage value Vpr to be applied to the priming electrode Pr is set at a larger value than the data voltage value Vd to be applied to the data electrode D (the data electrode 9 of FIG. 1) during the address period.

Further, as long as the voltage value applied to the priming electrode Pr during the address period is positive relative to the voltage value applied to the priming electrode Pr during the reset period, it may be a negative voltage value relative to the GND (ground) level.

As mentioned above, since the priming discharge occurs when a scan pulse is applied to the scan electrode in the priming discharge cell, it is possible to generate a priming discharge without fail at a time of addressing and decrease the discharge time lag more effectively at a time of addressing. Thus, the priming discharge can be produced assuredly in the interstice portion and the address characteristics can be made more stable.

In the embodiment, as shown in FIG. 1, FIG. 3, FIG. 4, and FIG. 5, the priming discharge is vertically produced between the scan electrode 6 provided on the front substrate 1 and the priming electrode 14 provided on the rear substrate 2, and this priming electrode 14 crosses the data electrodes 9 only in the region of the interstice portion 13. Accordingly, it is possible to produce a priming discharge only in the interstice portion 13. Therefore, in contrast with the case of producing a priming discharge within the surface of the front substrate 1, it is possible to restrain the crosstalk generated by supplying more priming particles than necessary for priming to the adjacent discharge cell 11.

Further, the purpose of using the priming discharge is to stabilize the address characteristics when the display screen is given finer resolution. When a priming discharge is produced within the surface of the front substrate 1, a certain distance between electrodes is necessary to get a stable priming discharge, and thus the auxiliary discharge cell, namely, the priming discharge cell, becomes larger. Because of this, the proportion of the area of all the discharge cells occupied by priming discharge cells is increased, hence deteriorating the brightness of the panel. When a priming discharge is caused to occur in a space other than within the surface of the front substrate 1 when the scan pulse is applied, there is the problem that a structure allowing some of the scan electrodes 6 to be wired on the rear substrate 2 and allowing extraction of the electrodes is complicated and further there is the problem that it is difficult to assure stability against the voltage at that time.

By generating the priming discharge vertically between the scan electrode 6 provided on the front substrate 1 and the priming electrode 14 provided on the rear substrate 2, the priming discharge cell can be made smaller, and a plasma display panel superior in addressing characteristics and with improved brightness can be realized even if the panel is made with finer resolution.

As mentioned in this embodiment, the priming electrode 14 is positioned nearer to the discharge space 3 where priming discharge is generated than the data electrode 9. Therefore, the distance between the priming electrode 14 and the scan electrode 6 becomes smaller, this decreases the discharge staring voltage, and the priming discharge can be generated in the interstice portion 13 with a low voltage. Further, since this embodiment allows easily generation of the priming discharge earlier than the address discharge, the address characteristic can be improved.

Further, the priming electrode 14 is provided only in the region corresponding to the adjacent electrodes 6. Therefore, a priming discharge occurs only between the scan electrode 6 and the priming electrode 14, and a wrong discharge between the priming electrode 14 and the sustain electrode 7 can be prevented.

Figure 9A:
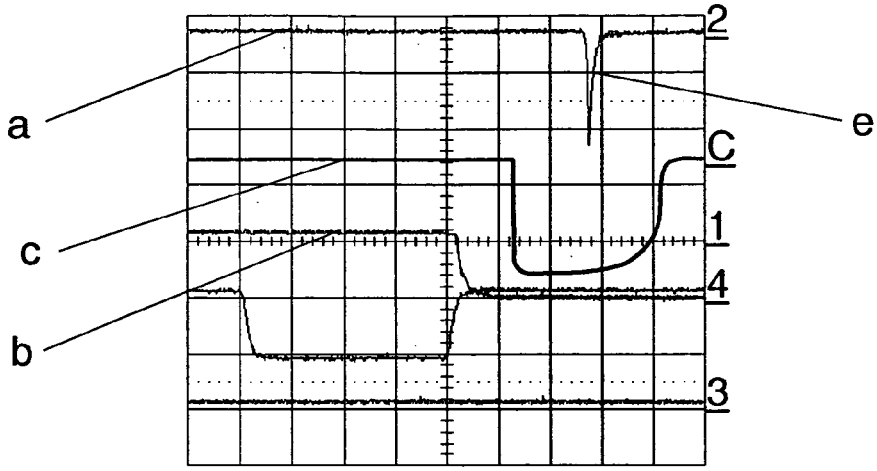
FIG. 9A is a characteristic view showing one example of the characteristic of a discharge time lag when there is no priming discharge in the same plasma display panel.
Figure 9B:
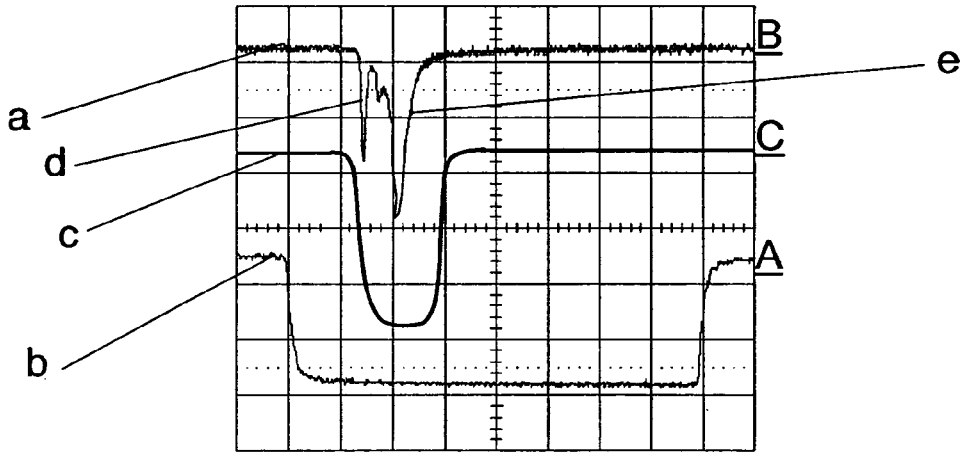
FIG. 9B is a characteristic view showing one example of the characteristic of a discharge time lag when there is priming discharge in the same plasma display panel.
Figure 9C:
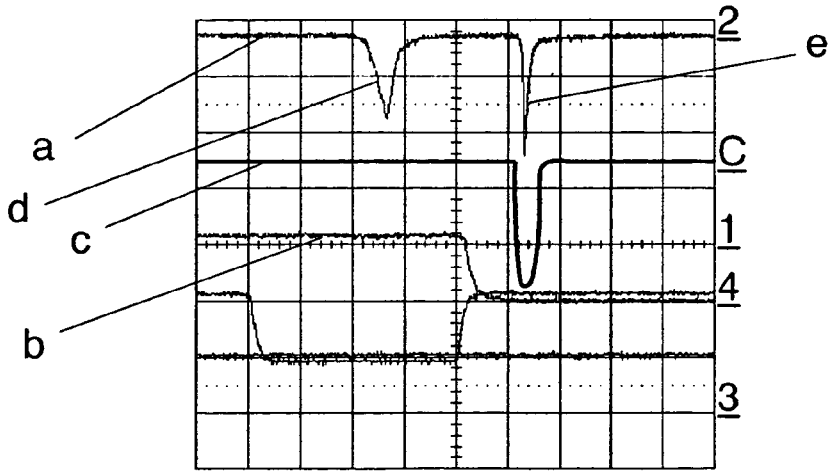
FIG. 9C is a characteristic view showing another example of the characteristic of a discharge time lag when there is priming discharge in the same plasma display panel.
Figure 10:
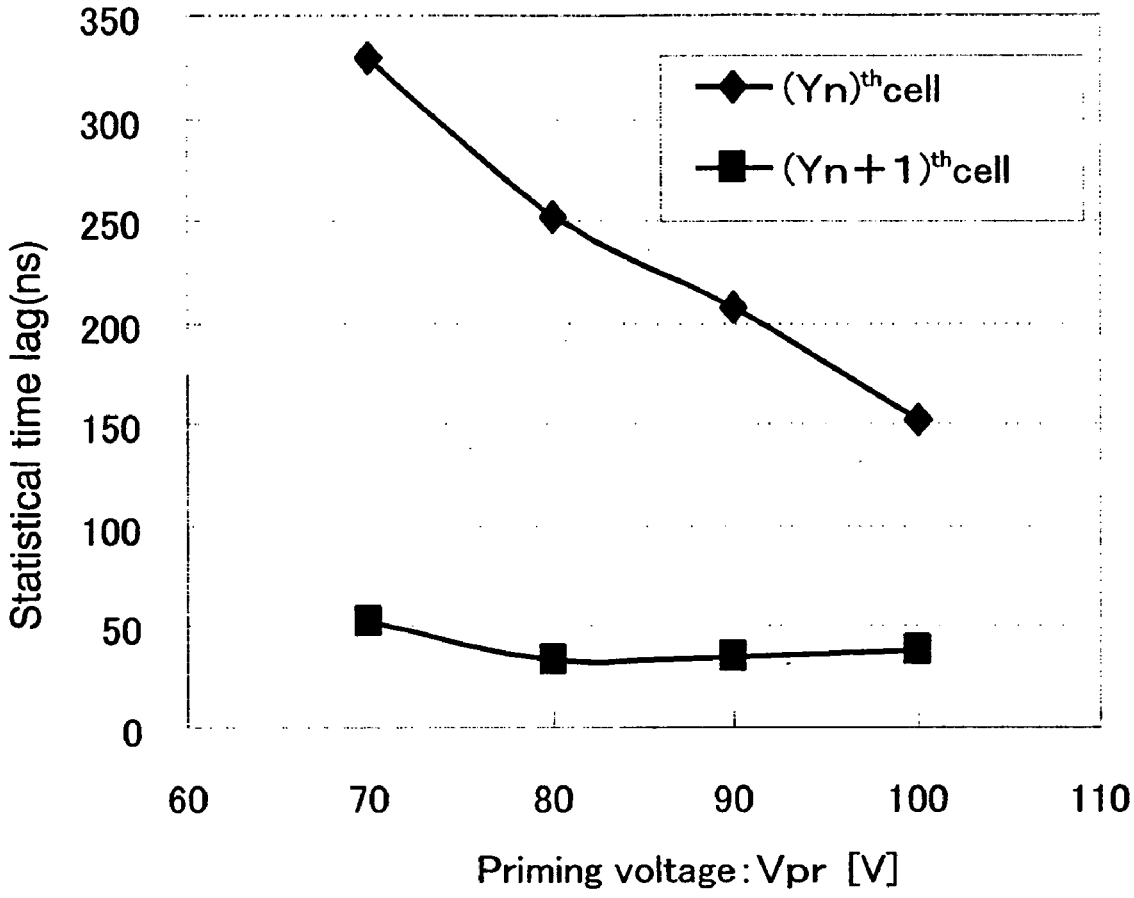
FIG. 10 is a characteristic view showing one example of the statistical time lag in a discharge according to the priming voltage in the same plasma display panel.

FIG. 9 is a graph of one example of the discharge time lag characteristic of the plasma display panel, the horizontal axis indicating the time. FIG. 9A shows the case where there is no priming discharge, FIG. 9B and FIG. 9C show the case where there is a priming discharge, FIG. 9B shows characteristics of the cell of the $Yn^{th}$ scan electrode, and FIG. 9C shows the characteristic of the cell of the $(Yn+1)^{th}$ scan electrode. Further, FIG. 10 shows the statistical time lag time of a discharge after application of the voltage Vpr to the priming electrode Pr in the cases of the cell of the $Yn^{th}$ scan electrode and the cell of the $(Yn+1)^{th}$ scan electrode.

In FIG. 9, the letter a indicates a light-emission output waveform, the letter b indicates a voltage waveform applied to the scan electrode, the letter c indicates a probability distribution of discharge, the letter d indicates a light-emission output waveform of priming discharge, and the letter e indicates a light-emission output waveform of writing discharge. The probability distribution of the discharge of c indicates a discharge time lag. Comparing FIGS. 9A, (b), and (c), when there is priming discharge as shown in FIGS. 9B and (c), the probability distribution of the discharge is sharper than in the case where there is no priming discharge in FIG. 9A. Accordingly, it is found that the discharge time lag is small. Because there is a priming discharge when the scan pulse is applied to the scan electrode Yn of the $Yn^{th}$ discharge cell, the discharge time lag in the $Yn^{th}$ cell is rather large, but since the $(Yn+1)^{th}$ discharge cell has been already affected by the priming discharge, it is possible to make the discharge time lag of the $(Yn+1)^{th}$ discharge cell extremely small On the other hand, as illustrated in FIG. 10, with increase of the priming voltage Vpr, it is found that the statistic time lag of the discharge is greatly reduced, especially in the $Yn^{th}$ cell which is performing the priming discharge when the scan pulse is applied. The statistic time lag of the discharge when there is no priming discharge is about 2400 ns, which shows that the discharge time lag can be extremely improved according to the invention.

Figure 11A:
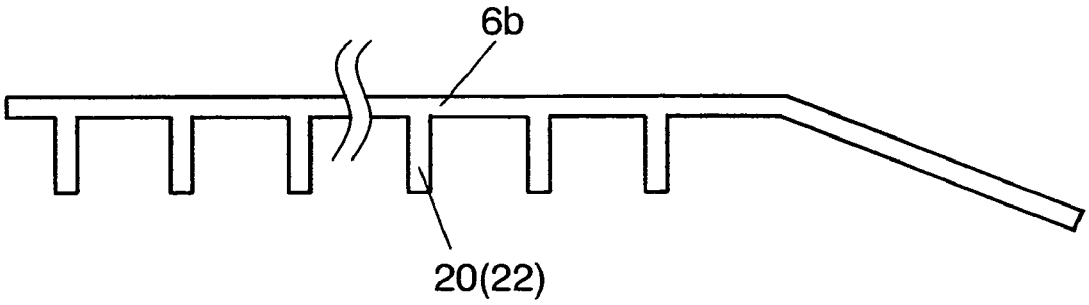
FIG. 11A is a plan view showing one example of a scan electrode drawn out from the same plasma display panel phosphor layer 13.
Figure 11B:
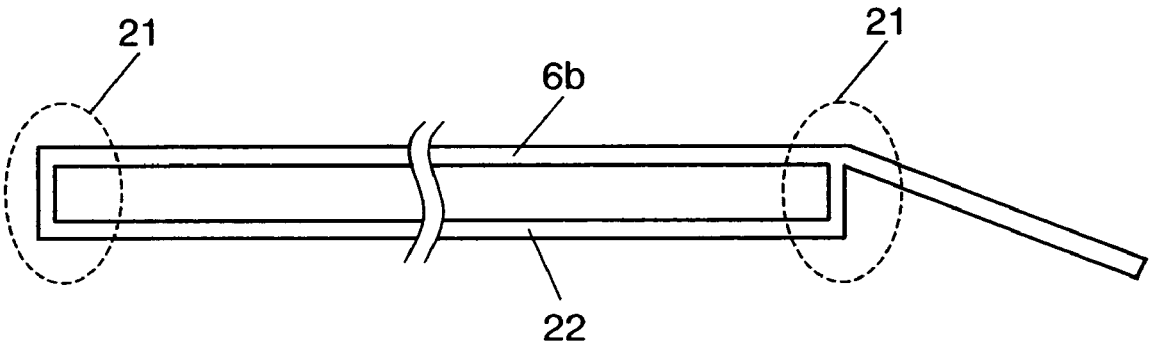
FIG. 11B is a plan view showing another example of a scan electrode drawn out from the same plasma display panel phosphor layer 13.

FIG. 11 is a plan view showing an example of drawing the scan electrode 6. FIG. 11A shows an example where a metal bus line 6*b* of the scan electrode 6 is made to protrude toward the data electrode 9, and protruding portions 20 serving as priming scan electrode portions 22 are formed. FIG. 11B shows an example of providing a connection portion 21 in a non-display area of the metal bus line 6*b*, hence to be connected with the scan electrode portion 22 for priming. In FIG. 11, a slanted portion of the metal bus line 6*b* is used for removing the electrode. Though the priming discharge can be surely and stably performed in any case, it can be performed with still greater certainty by providing the scan electrode portion 22 for priming continuously within the interstice portion 13 where the priming discharge is produced, as shown in FIG. 11B.

The interstice portion 13 for producing the priming discharge is continuously formed in a direction orthogonal to the data electrodes 9. Therefore, it is possible to decrease disuniformity of the priming discharge produced within the long interstice portion 13 along the priming electrode 14.

Further, in the embodiment, the rectangle discharge cell 11 is formed by providing barrier rib 10 comprising the longitudinal barrier rib 10*a* and the side barrier rib 10*b* on the rear substrate 2 and the interstice portion 13 is a space formed in parallel with the scan electrode 6 and the sustain electrode 7. The invention, however, is needless to say not restricted to the discharge cell of this shape, and can have a discharge cell having a wave-shaped barrier rib.

Further, in the embodiment of the invention, two scan electrodes 6 and two sustain electrodes 7 are alternately arranged as illustrated in FIG. 2. Therefore, in the discharge cell, the electrodes of the portions in adjacent columns become the same potential, thereby decreasing the discharge electricity escaping between the adjacent cells and thus reducing the electricity consumption.

Further, in the embodiment of the invention, as illustrated in FIG. 1, on the side of, the front substrate 1, the light absorption layers 8 are respectively formed between the adjacent scan electrodes 6 and between the adjacent sustain electrodes 7. Therefore, this light absorption layer 8 can prevent the light-emission of the priming discharge in the interstice portion 13 from escaping, hence preventing deterioration in contrast while improving the addressing characteristics.

Figure 12:
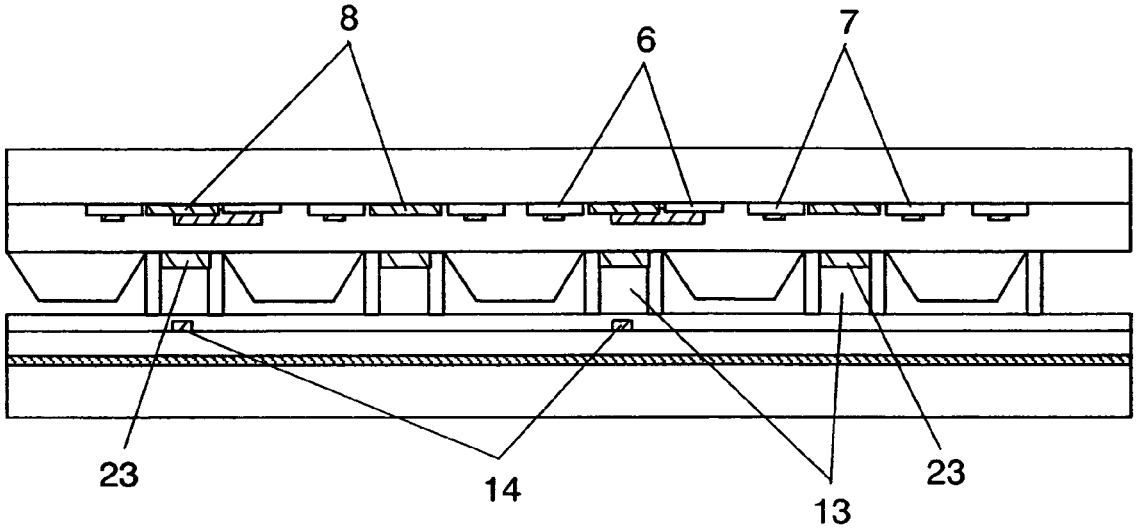
FIG. 12 is a cross sectional view of the same plasma display panel with a second light absorption layer provided therein.

Further, the plasma display panel as shown in FIG. 12 has the same structure as that of FIG. 1, and further second light absorption layers 23 are provided on the dielectric layer 4 or the protective film 5 and between the adjacent scan electrodes 6 and between the sustain electrodes 7. Therefore, it is possible to improve the contrast further.

Since the light absorption layer 8 or the second light absorption layer 23 is thus provided on the front substrate 1 at a position corresponding to the interstice portion 13, the phosphor may enter into the interstice portion 13 and the formation of the phosphor becomes easy.

In FIG. 1 and FIG. 12, though the light absorption layer 8 is provided also between the sustain electrodes 7, since no priming discharge occurs in this interstice portion 13, it is also possible to form this interstice portion without providing the light absorption layer.

[Embodiment 2]

Figure 13:
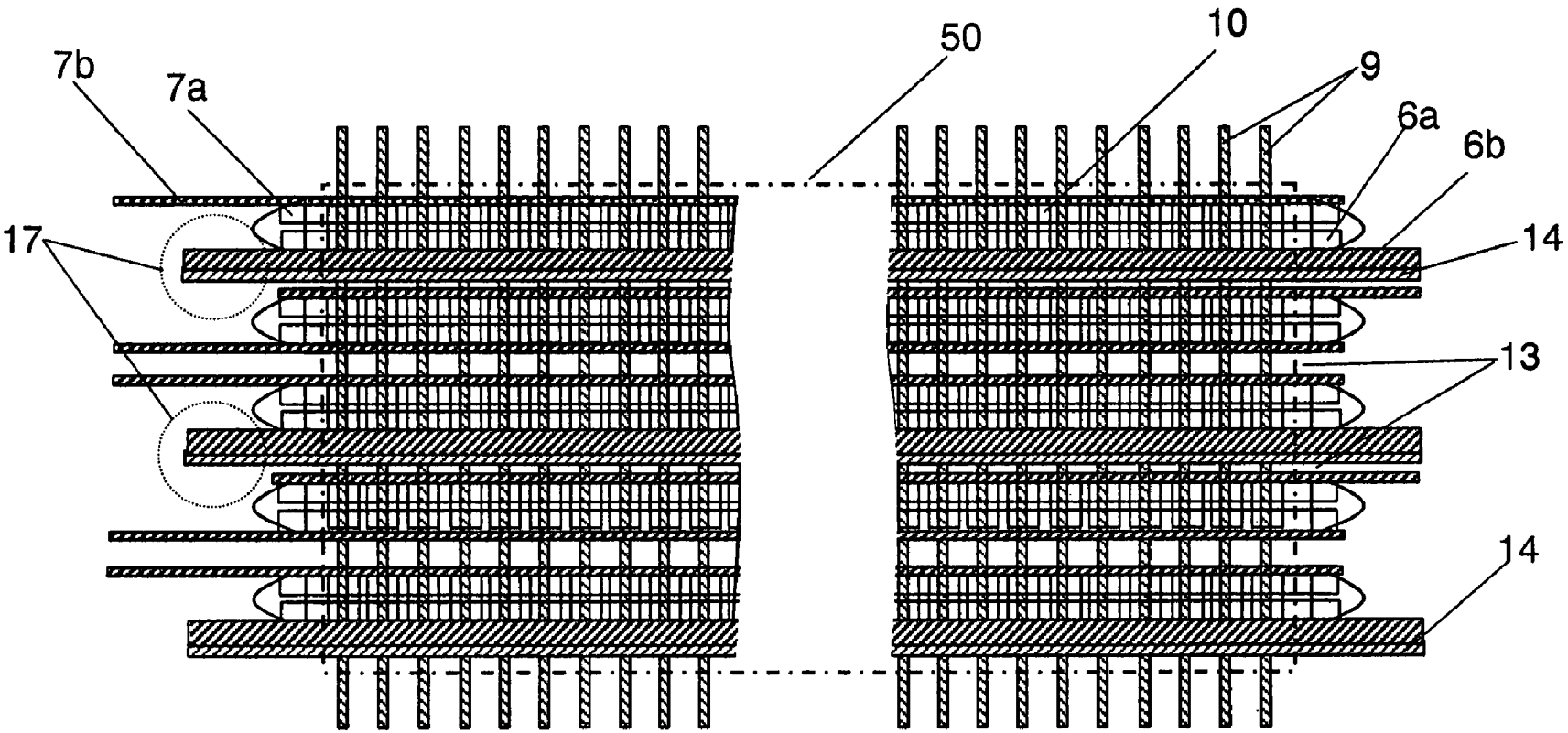
FIG. 13 is a plan view showing the structure of an important portion of the plasma display panel according to the embodiment 2 of the invention.

FIG. 13 is a plan view showing the structure of an important portion of the plasma display panel according to the embodiment 2 of the invention. In the embodiment 2, a discharge area for inducing a priming discharge between the front substrate 1 and the rear substrate 2 within the interstice portion 13 is provided in the peripheral portion around the display area of the plasma display panel.

It is necessary to produce a priming discharge which itself is stable and without discharge time lag in a method for improving the addressing characteristics by such priming discharge. In the embodiment 2, a discharge area for producing an auxiliary discharge which can be a stable priming discharge is formed in the peripheral portion of the panel.

As illustrated in FIG. 13, the metal bus line 6*b* of the scan electrode 6 corresponding to the priming electrode 14 extends to the peripheral area around the display area 50 formed by the barrier rib 10 and similarly, the priming electrode 14 also extends to, the peripheral area around the display area 50. Therefore, areas 17 for auxiliary discharge of the priming discharge are formed in the peripheral area, and the priming discharge can be produced stably without discharge time lag due to the auxiliary discharge produced in this area. Although the example in the case of producing the discharge between the scan electrodes 6 and the priming electrode 14 in the auxiliary discharge area 17 shown in FIG. 13, the auxiliary discharge may instead be produced between the scan electrode 6 and the electrode formed in parallel with the data electrode 9.

[Embodiment 3]

Figure 14:
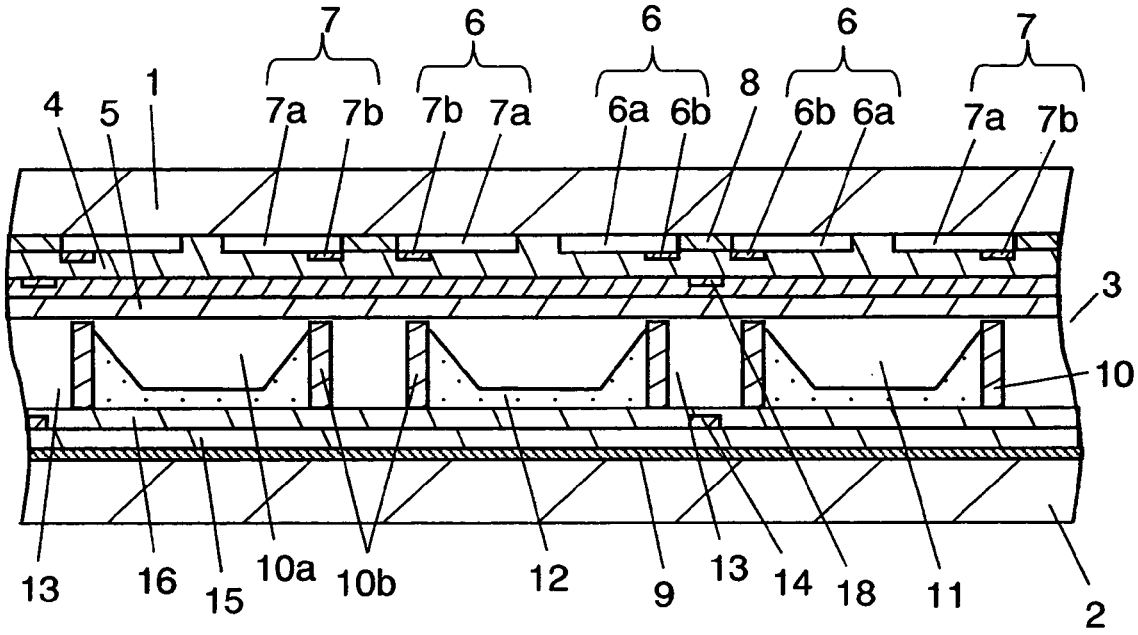
FIG. 14 is a cross sectional view showing the plasma display panel according to the embodiment 3 of the invention.

FIG. 14 is a cross sectional view showing the plasma display panel according to the embodiment 3 of the invention. In the embodiment 3, in addition to the priming electrode 14 formed on the rear substrate 2, a priming electrode 18 is formed in the area corresponding to the interstice portion 13, between the interstice portion 13 and the front substrate 1. A new voltage waveform other than that of the scan electrode 6 may be applied to this priming electrode 18, even if its potential is the same as that of the scan electrode 6. It is possible to produce a priming discharge within the interstice portion 13 at a higher speed by forming this electrode structure, hence enabling faster writing.

[Embodiment 4]

Figure 15:
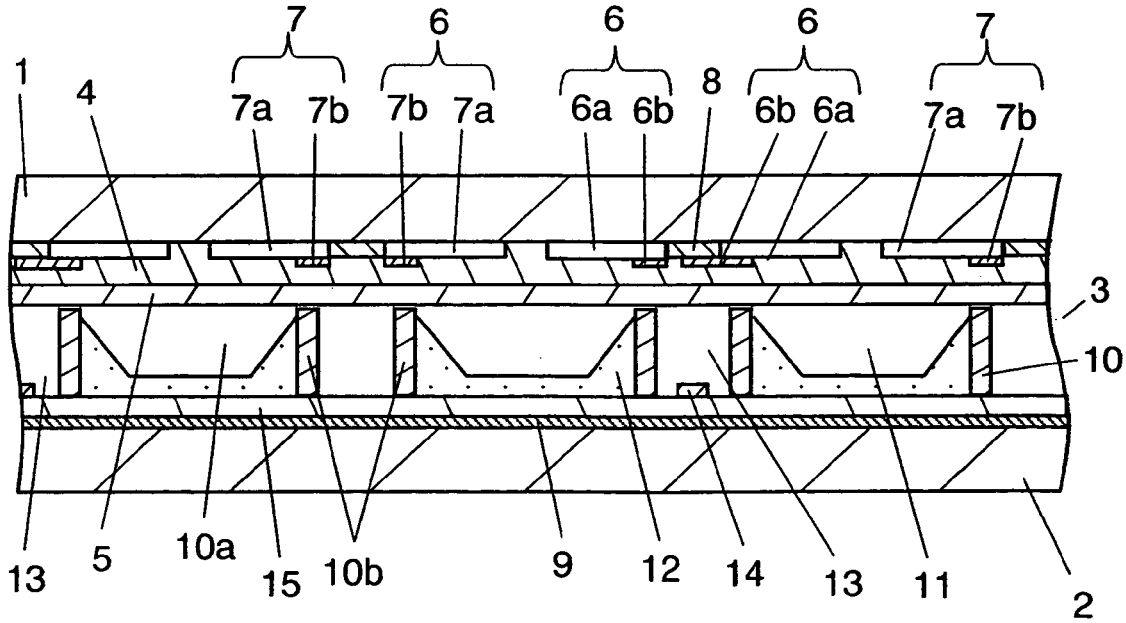
FIG. 15 is a cross sectional view showing the plasma display panel according to the embodiment 4 of the invention.

FIG. 15 is a cross sectional view showing the plasma display panel according to the embodiment 4 of the invention. In the embodiment 4, the priming electrode 14 formed on the side of the rear substrate 2 in the embodiment 1 shown in FIG. 1 is not covered with the dielectric layer 16 but exposed to the space of the interstice portion 13.

By exposing the priming electrode 14, it is possible to make a voltage for the priming discharge at a low voltage.

[Embodiment 5]

Figure 16:
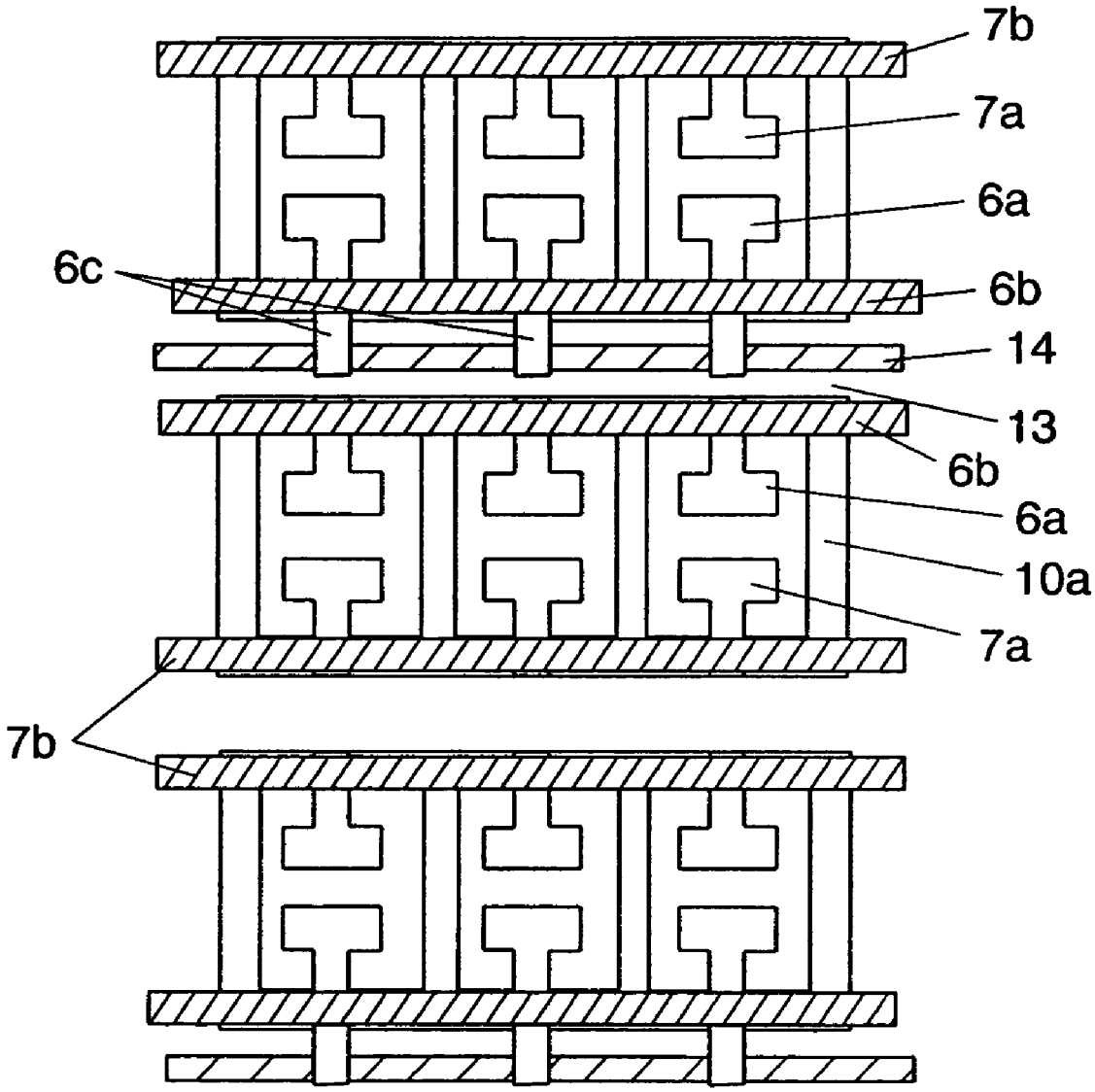
FIG. 16 is a plan view showing the structure of an important portion of the plasma display panel according to the embodiment 5 of the invention.

FIG. 16 is a plan view showing the structure of an important portion of the plasma display panel in the embodiment 5 of the invention. In the embodiment 5, the transparent electrodes 6*a* and 7*a* for forming the scan electrode 6 and the sustain electrode 7 are both formed in T-shape, and one of the transparent electrodes 6*a* of the scan electrode 6 is protruded from the metal bus line 6*b*, this protrusion being the electrode portion 6*c* facing the priming electrode 14. By devising the shape of the electrode as mentioned above, it is possible to control the size of the priming discharge.

[Embodiment 6]

Figure 17:
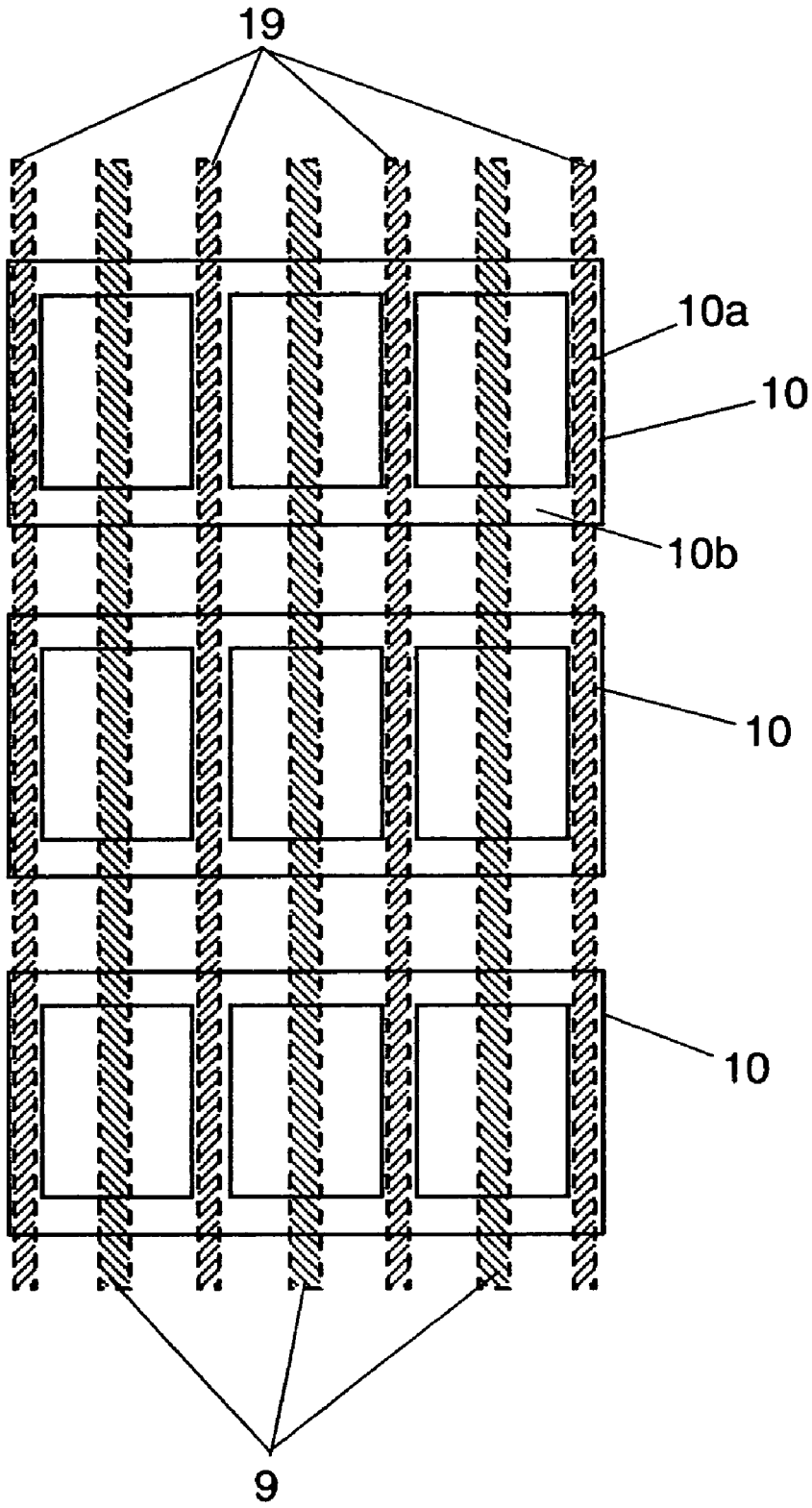
FIG. 17 is a plan view showing the structure of the rear substrate of the plasma display panel according to the embodiment 6 of the invention.

FIG. 17 is a plan view showing the structure of the rear substrate of the plasma display panel in the embodiment 6 of the invention. In the embodiment 6, the priming electrodes 19 are formed on the same surface as the data electrodes 9, extending under the longitudinal barrier rib 10*a* of the barrier rib 10. By forming the panel in this way, it is possible to eliminate crossing of the data electrode 9 and the priming electrode 19, thereby improving the ability of the data electrode 9 and the priming electrode 19 to withstand high voltage, and restraining the generation of useless electricity at the crossing the data electrode 9 and the priming electrode 19.

[Embodiment 7]

Figure 18:
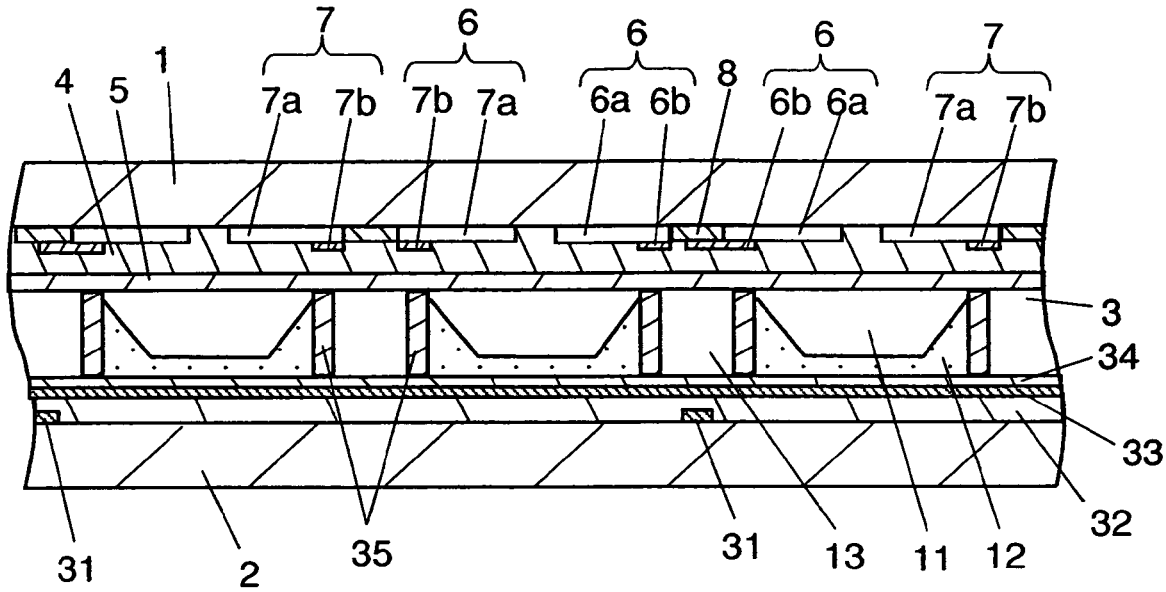
FIG. 18 is a cross sectional view showing the plasma display panel according to the embodiment 7 of the invention.

FIG. 18 is a cross sectional view showing the plasma display panel according to the embodiment 7 of the invention. As shown in FIG. 18, in the embodiment 7, the structure of a data electrode 33 that is the third electrode and a priming electrode 31 that is the fourth electrode which are formed on the rear substrate 2 is different from the structure mentioned in embodiment 1.

Namely, in embodiment 7, the priming electrode 31 is formed on the rear substrate 2 at first, a dielectric layer 32 is provided to cover the priming electrode 31, and a data electrode 33 is provided on the dielectric layer 32. Further, the data electrode 33 is covered by a dielectric layer 34 that becomes the groundwork for forming the barrier rib, and the barrier rib 35 is formed on the dielectric layer 34. Thus, in the embodiment 7, only the structure on the rear substrate 2 is different from the embodiment 1 and the structure of the front substrate 1 is the same as that of the embodiment 1.

According to the embodiment 7, the data electrode 33 is formed at a position nearer to the discharge space 3 than the priming electrode 31. Therefore, it is possible to thin the dielectric layer 34 formed on the data electrode 33 and lower the voltage of the address discharge, thereby stabilizing the address discharge. The dielectric layer 32 formed on the priming electrode 31 is an insulating layer between the priming electrode 31 and the data electrode 33 and the same layer of any thickness and material sufficient to secure the insulation of both may be chosen.

As mentioned above, the invention is able to produce with certainty a priming discharge in the interstice portion that is the priming discharge cell, and so stabilize the addressing characteristics.

INDUSTRIAL APPLICABILITY

Since the plasma display panel according to the invention can produce a priming discharge in a small space assuredly, it can be useful for plasma display panels with high resolution, since it has small discharge time lag and favorable addressing characteristics.

The invention claimed is:

1. A plasma display panel comprising:

a first electrode and a second electrode arranged on a first substrate parallel with each other and covered with a dielectric layer;

a third electrode arranged on a second substrate facing the first substrate across a discharge space and arranged in a direction crossing the first electrode and the second electrode; and a fourth electrode arranged on the second substrate for producing a discharge between the fourth electrode and the first electrode.

2. The plasma display panel according to claim 1, further comprising:

barrier ribs for dividing a plurality of discharge cells each formed by the first electrode, the second electrode and the third electrode into sections on the second substrate, wherein a phosphor layer is provided on the discharge cells.

3. The plasma display panel according to claim 2, wherein the barrier rib is formed by a longitudinal barrier rib portion orthogonal to the first electrode and the second electrode and a side barrier rib portion extending in a direction traverse to a direction in which the longitudinal barrier rib portion extends so as to form an interstice portion and wherein the fourth electrode is formed on the second substrate at the interstice portion.

4. The plasma display panel according to claim 3, wherein an interstice portion is a continuous space formed by the adjacent side barrier rib portions in parallel with the first electrode and the second electrode.

5. The plasma display panel according to claim 1, wherein a light absorption layer is formed on the first substrate at a position corresponding to a discharge space formed by the fourth electrode.

6. The plasma display panel according to claim 5, wherein the light absorption layer is formed on the surface area of the first substrate where it bounds the discharge space.

7. The plasma display panel according to claim 1, wherein the fourth electrode is formed at a position nearer to the discharge space than the third electrode.

8. The plasma display panel according to claim 1, wherein the third electrode is formed at a position nearer to the discharge space than the fourth electrode.

9. The plasma display panel according to claim 1, wherein when a scan pulse is applied, a priming discharge is produced between the first electrode where the scan pulse is applied and the fourth electrode.

10. The plasma display panel according to claim 1, wherein a pair of first electrodes and a pair of second electrodes are arranged so as to alternate with each other.

11. The plasma display panel according to claim 10 wherein the fourth electrode is formed on the second substrate corresponding to a portion of a display area where the pair of the first electrodes adjoin each other on which scan pulses are applied.

12. The plasma display panel according to claim 1, wherein a discharge area for inducing a discharge between the first electrode on the first substrate and the fourth electrode on the second substrate is formed in a peripheral portion outside a display area.

13. The plasma display panel according to claim 1, wherein the fourth electrode for producing a discharge between the first substrate and the second substrate produces the discharge during an address period.

14. The plasma display panel according to claim 1, wherein the fourth electrode applies a positive voltage pulse during an address period.

15. The plasma display panel according to claim 14, wherein a value of the positive voltage pulse applied to the fourth electrode during the address period is set larger than a voltage value applied to the third electrode during the address period.

* * * * *